US005809889A

United States Patent [19]

Holm

[11] Patent Number: 5,809,889

[45] Date of Patent: Sep. 22, 1998

[54] PROCESS AND DEVICE FOR SECURING AND TIGHTENING A PACKING ON THE CYLINDER OF A ROTARY PRINTING MACHINE

[75] Inventor: Helmut Holm, Erlabrunn, Germany

[73] Assignee: Koenig & Bauer-Albert Aktiengesellschaft, Wurzburg, Germany

[21] Appl. No.: 765,441

[22] PCT Filed: Jul. 13, 1995

[86] PCT No.: PCT/DE95/00913

§ 371 Date: Jan. 16, 1997

§ 102(e) Date: Jan. 16, 1997

[87] PCT Pub. No.: WO96/02391

PCT Pub. Date: Feb. 1, 1996

[30] Foreign Application Priority Data

Jul. 16, 1994 [DE] Germany ..... 44 25 189.0

[51] Int. Cl.[6] ..... B41F 27/12

[52] U.S. Cl. ..... 101/415.1

[58] Field of Search ..... 101/415.1

[56] References Cited

U.S. PATENT DOCUMENTS

| | | | |
|---|---|---|---|
| 1,582,390 | 4/1926 | Evans | 101/415.1 |
| 2,729,164 | 1/1956 | Stempel | 101/415.1 |
| 2,885,958 | 5/1959 | Johnson et al. | 101/415.1 |
| 3,296,673 | 1/1967 | Kirkpatrick | 101/415.1 |
| 3,495,531 | 2/1970 | Thatcher | 101/415.1 |
| 3,584,580 | 6/1971 | Schulz | 101/415.1 |
| 4,337,700 | 7/1982 | Etchell et al. | 101/415.1 |
| 4,833,986 | 5/1989 | Kobler | 101/415.1 |
| 5,329,853 | 7/1994 | Stegmeir et al. | 101/415.1 |

FOREIGN PATENT DOCUMENTS

| | | |
|---|---|---|
| 0 099 275 | 6/1983 | European Pat. Off. . |
| 407871 | 1/1925 | Germany . |
| 431764 | 7/1926 | Germany . |
| 1 948 168 | 7/1970 | Germany . |
| 31 09 859 | 5/1983 | Germany . |
| 37 07 066 | 1/1992 | Germany . |

*Primary Examiner*—Edgar S. Burr
*Assistant Examiner*—Leslie Grohusky
*Attorney, Agent, or Firm*—Jones, Tuller & Cooper, P.C.

[57] ABSTRACT

A packing is secured to a cylinder of a rotary printing machine. The ends of the packing have suspension strips that are placed in a cylinder channel. A tightening strip is movable radially in the cylinder channel. One suspension strip is held, by one side of the tightening strip, in a channel groove in the cylinder channel. The other suspension strip is movable radially in the cylinder channel by radial movement of the tightening strip.

8 Claims, 1 Drawing Sheet

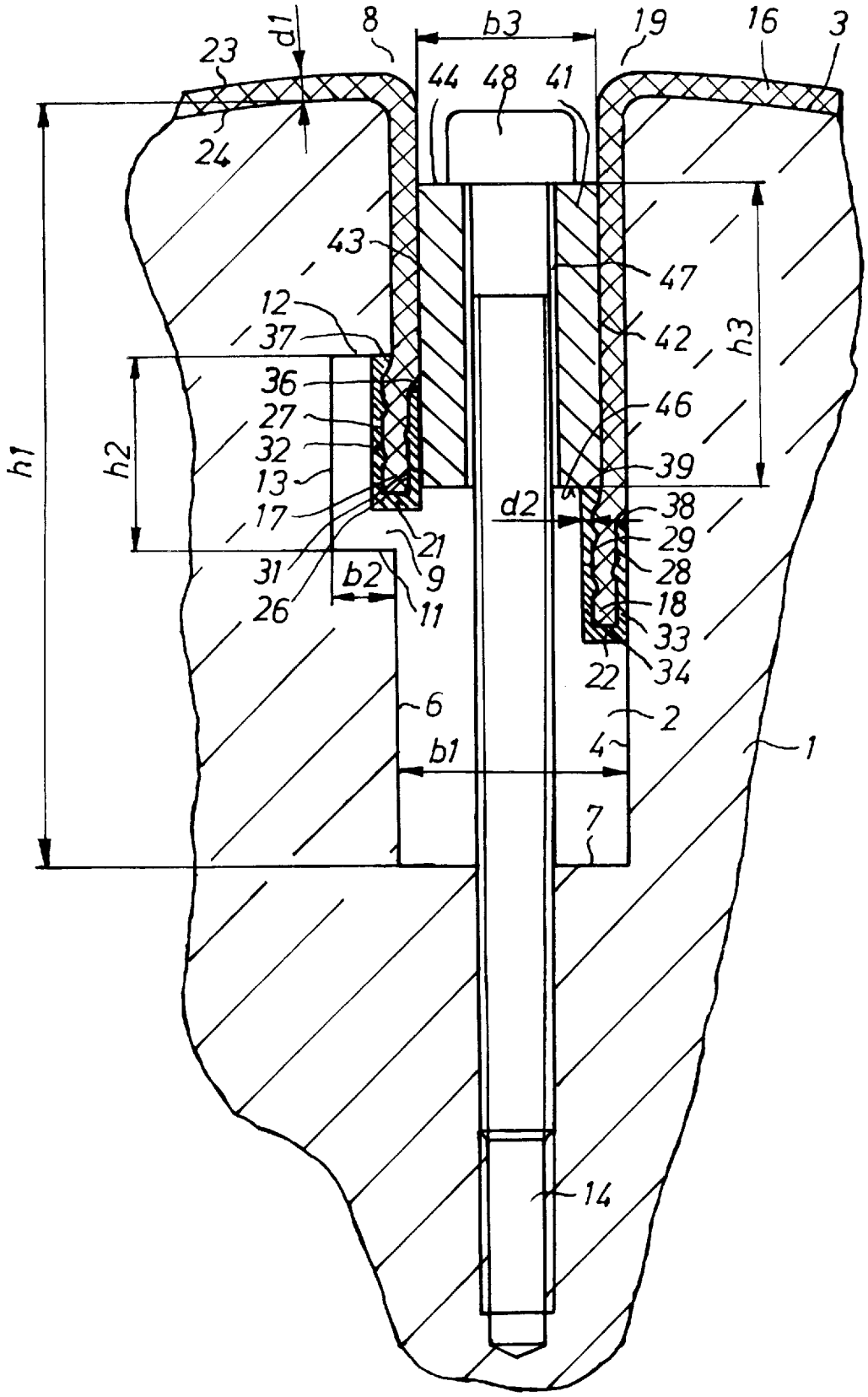
d1
8
b3
19
16
3
23
44
48
41
24
43
47
12
37
42
h3
36
46
27
32
39
h1
h2
13
d2
38
17
29
21
28
31
9
b2
18
26
11
33
34
22
6
2
b1
4
1
7
14

PROCESS AND DEVICE FOR SECURING AND TIGHTENING A PACKING ON THE CYLINDER OF A ROTARY PRINTING MACHINE

FIELD OF THE INVENTION

The present invention relates to a process and to a device for securing and tightening a packing on a cylinder of a rotary printing press.

DESCRIPTION OF THE PRIOR ART

A prior art device for securing and tightening a packing is known from EP 00 99 275 B1. A longitudinal and radial cut in a cylinder of a printing press is provided as a cylinder channel. It is possible to radially move a tightening strip in this cylinder channel by means of tightening screws. This tightening strip is provided with shoulders, offset from each other, for engagement with the print start and print end portions of the plate or packing. Edges of suspension strips, which are fastened on the respective ends of the packing, are held in place by means of these shoulders.

DE 37 07 066 C2 shows a tightening device for the interconnected fastening of a packing on a cylinder of a rotary printing press. The cylinder has a channel, extending axis-parallel in the cylinder surface, with a tightening strip, which can be moved radially inward during the tightening process. On its upper part, this tightening strip is provided on each of its two sides with a recess for receiving reinforced ends of the packing.

The disadvantage of these prior art devices is that it is not possible to compensate for the loosening of one end of the packing which arises because of flexing processes occurring during the first printing following the application of the packing. With these known prior art devices, it is only possible to tighten both ends of the plate or packing evenly, but an adjustment between the two ends is not possible because of large static friction forces between the packing and the cylinder. Thus it is either not possible to tighten the loose end portion of the packing in accordance with the requirements, or the fixed end is overstretched, i.e. destroyed. The reinforced ends can also be ripped off or torn.

SUMMARY OF THE INVENTION

It is the object of the present invention to provide a process and a device, which does not utilize a tightening spindle, for securing and tightening a packing on a cylinder of a rotary printing press, by means of which the one-sided loosening of the packing at the print end, which is caused by flexing processes in the course of printing, can be prevented.

This object is attained in accordance with the present invention by means of a process or a device for securing and tightening a packing on a cylinder of a rotary printing press. The surface of the cylinder is provided with a cylinder channel. A pair of suspension rails are provided at the ends of the cylinder packing and these suspension rails are securable in the axially extending cylinder channel. A tightening strip is situated in the cylinder channel. One suspension strip is held in a groove in the cylinder channel by a side surface of the tightening strip. The other suspension edge is movable radially in the cylinder channel by movement of the tightening strip, also in a radial direction in the cylinder channel. This allows one end of the packing to be tightened while the other end is held in place.

It is possible in an advantageous manner to retighten a packing of a cylinder at the print end portion of the packing.

Packings on a cylinder of a rotary printing press which are applied and tightened for the first time are loosened by the flexing processes which typically occur in the course of printing. These flexing processes begin at the print start portion of the packing and flex the packing in the direction toward the print end portion of the packing, because of which loosening of the end portion of the packing located at the print end takes place. Experience has shown that therefore only the print end portion of the packing must be specially retightened, because an even tightening of the packing in accordance with the flexing process takes place because of this. A one-time retightening process is sufficient in most cases, but it is also possible to retighten several times.

The different lengths of lateral legs of the suspension strips is additionally advantageous, since damage is prevented even with a displacement of the suspension strips in respect to the packing which occurs with a tightened packing.

The tightening strip is furthermore distinguished by being a component which can be produced particularly simply and cost-effectively.

BRIEF DESCRIPTION OF THE DRAWING

The device for securing and tightening a packing on a cylinder of a rotary printing machine in accordance with the present invention is represented in the drawing and will be described in detail below.

The sole drawing FIGURE shows a schematic radial section of the device in accordance with the present invention.

DETAILED DESCRIPTION OF THE PREFERRED EMBODIMENT

A cylinder 1, preferably the rubber blanket cylinder 1, of a rotary printing press has a cylinder pit or channel 2 extending parallel with the cylinder's axis of rotation and extending over the length of the cylinder. This cylinder pit or channel 2 is embodied in the form of a U-shaped groove extending from the surface 3 of the cylinder 1 radially in the direction toward the axis of rotation of the cylinder 1. The cylinder pit or channel 2 of a width "b1" and a height "h1" is delimited by two parallel and approximately radially extending lateral surfaces 4, 6 of a height "h1", and by a base surface 7 of a width "b1" extending perpendicularly in respect to these lateral surfaces 4, 6. The lateral surface 6 located at the print start, i.e. the left lateral surface 6 when the cylinder 1 is turned to the right, is provided with a U-shaped groove 9 extending parallel with the axis of rotation of the cylinder 1, and over the length of the lateral surface 6. This groove 9 has lower and upper groove lateral surfaces 11 and 12, respectively, each of a width b2, which are parallel with the base surface 7 of the cylinder pit 2, and a groove base surface 13 of a height "h2" which is parallel with the lateral surfaces 4, 6 of the cylinder pit or channel 2. Several blind-bore-like threaded bores 14 have been radially cut at even distances along the cylinder length into the base surface 7 of the cylinder pit 2.

A packing 16, in particular a rubber blanket 16 of a thickness "d1", has a forward end 17 located at the print start portion 8 and a rear end 18, located at the print end portion 19. The two ends 17 and 18 are each reinforced or edged, for example by means of suspension rails 21 and 22 respectively, which suspension rails 21 and 22 each enclose the respective plate end 17 or 18 on three sides. These suspension rails 21 and 22 extend along the cylinder pit or channel 2 and can be made in a U-shape from metal or a dimensionally stable plastic material.

Inward facing lateral surfaces 26 and 27; 28 and 29, and which rest against or engage the top and underside surfaces 23 and 24 of the rubber blanket 16, each form one part of respective right and left lateral legs 31, 32, 33, 34 of the U-shaped suspension rails 21, 22. These inward facing lateral surfaces 26 and 27, and 27 and 29 can be profiled, i.e. can be provided with raised places, in order to obtain, besides the frictional connection achieved by pressing the suspension rails 21, 22 together, also an interlocking connection. However, the suspension rails 21, 22 can also be connected with the respective ends 17 and 18 of the rubber blanket 16 by means of an adhesive connection or by vulcanizing. The lateral legs 31, 32, 33, and 34 of each of the suspension rails 21 and 22 are each of a thickness "d2" and project by approximately this thickness "d2" past the surface of the rubber blanket and in this way each constitute a pressure surface 36, 37, 38, 39, respectively extending perpendicularly in respect to the respective lateral leg 31, 32, 33, 34. The thickness "d2" of the lateral legs 31, 32, 33, 34 of the suspension rails 21, 22 is less than the thickness "d1" of the rubber blanket 16.

The suspension rails 21, 22 can each have lateral legs 31, 32, 33, 34, respectively of different length at the print start portion 8 and the print end portion 19 of the packing 16. Thus, in the represented example, the outer lateral leg 32 at the print start portion 8, facing the lateral surface 6 of the cylinder pit 2, is longer by at least the thickness "d1" of the rubber blanket 2 than the oppositely located lateral leg 31 of the suspension rail 21. At the print end portion 19 of the packing 16, the lateral leg 33 of the suspension rail 22 facing the lateral surface 4 of the cylinder pit 2 is shorter by at least the thickness d1 of the rubber blanket 16 than the oppositely located lateral leg 34 of the suspension rail 22. Damage to the rubber blanket 16 by the suspension rails 21 and 22 during the tightening process is prevented by means of this configuration of the suspension rails 21 and 22.

A tightening strip 41 is disposed in the cylinder channel 2 and extends over the length of the cylinder 1 parallel with the axis of rotation of the cylinder 1 and has, for example, a rectangular cross section of the width "b3" and height "h3". This width "b3" approximately corresponds to the width "b1" of the cylinder pit or channel 2 minus twice the thickness "d1" of the rubber blanket 16. The rectangular cross section of the tightening strip 41 is formed by two tightening strip lateral surfaces 42 and 43, which are parallel with the lateral surfaces 4, 6 of the cylinder pit 2, and by one upper base surface 44, and one lower base surface 46, which are parallel with the base surface 7 of the cylinder pit 2. Through-bores 47 are provided in this tightening strip 41, which correspond to the threaded bores 14 of the base surface 7 of the cylinder pit or channel 2. Tightening screws 48, projecting through the through-bores 47 of the tightening strip 41, cooperate with the threaded bores 14 of the base surface 7 of the cylinder pit 2.

The tightening strip 41, including the tightening screws 48, is removed from the cylinder pit 2 during installation of the rubber blanket 16. The rubber blanket 16 is placed on the surface 3 of the cylinder 1, and the ends 17 and 18 of the rubber blanket 16 are folded into the cylinder pit 2 so they rest against the appropriate lateral surfaces 4 and 6. The tightening strip 41, together with the associated tightening screws 48, is inserted into the cylinder pit or channel 2. The tightening screws 48 are screwed into the threaded bores 14 of the base surface 7 of the cylinder pit 2, because of which the tightening strip 41 is moved radially inward in the direction toward the axis of rotation of the cylinder 1. In the process, the lower base surface 46 of the tightening strip 41 pushes against the respective pressure surfaces 36 and 39 of the lateral legs 31 and 34, respectively of the suspension rails 21 and 22. When the pressure surface 37 of the lateral leg 32 at the print start 8 of the packing 16 has reached the upper lateral surface 12 of the U-shaped groove 9 of the left lateral surface 6, the suspension rail 21 is tilted because of the effect of the tensile force of the rubber blanket 16, and slides laterally out from under the tightening strip 41 into the groove 9. There the pressure surface 37 of the lateral leg 32 rests against the upper lateral surface 12 of the U-shaped groove 9.

In the course of further tightening of the tightening screws 48, the suspension rail 21 at the print start portion 8 of the packing 16 remains in the groove 9, while the suspension rail 22 at the print end portion 19 of packing 16 is further pulled radially in the direction toward the base surface 7 of the cylinder pit 2 by engagement of the suspension rail 22 with the tightening strip 41. The rubber blanket 16 is tightened by this, particularly at the print end portion 19.

For the removal of the rubber blanket 16, the tightening screws 48 and the tightening strip 41 are removed, whereupon the rubber blanket 16 can be taken off. In case of left-hand turning of the cylinder 1 the entire arrangement of the device is disposed in a mirror-reversed manner.

While a preferred embodiment of a method and device for securing and tightening a packing on a cylinder of a rotary printing machine in accordance with the present invention has been set forth fully and completely hereinabove, it will be apparent to one of skill in the art that a number of changes in, for example, the type of cylinder used, the type of printing being done, the drive for the cylinder and the like can be made without departing from the true spirit and scope of the present invention, which is accordingly to be limited only by the following claims.

What is claimed is:

1. A process for securing and tightening a packing on a cylinder of a printing machine including:

providing a U-shaped cylinder channel on a surface of said cylinder;

disposing said cylinder channel extending parallel to an axis of rotation of said cylinder;

providing leading and trailing suspension rails having upper pressure surfaces on print start and print end portions of said packing;

placing said leading and trailing suspension rails in said cylinder channel;

providing a tightening strip that is receivable in said cylinder channel;

placing said tightening strip in said cylinder channel subsequent to placing said leading and trailing suspension rails in said channel;

providing a channel groove on a first lateral wall of said cylinder channel and extending along said first lateral wall parallel to said axis of rotation;

moving said tightening strip radially inwardly in said cylinder channel and into engagement with said upper pressure surfaces of said leading and trailing suspension rails;

using said tightening strip to push said leading suspension rail into said channel groove and to disengage said leading suspension rail upper pressure surface from said tightening strip;

continuing to move said tightening strip and said trailing suspension rail radially inwardly in said cylinder channel past said leading suspension rail while securing said leading suspension rail in said groove; and tightening said print end portion of said packing during said continuing movement of said tightening strip and of said trailing suspension rail radially inwardly in said cylinder channel.

2. A device for tightening and securing a packing comprising:

a cylinder;

a packing on said cylinder, said packing having a print start portion, a print end portion and a packing thickness;

a U-shaped cylinder channel formed in said cylinder, said cylinder channel extending generally parallel to an axis of rotation of said cylinder, said cylinder channel having first and second channel lateral surfaces and a channel base surface;

leading and trailing suspension rails on said print start and print end portions of said packing, each of said leading and trailing suspension rails having left and right lateral legs, each of said left and right lateral legs having an upper pressure surface;

a tightening strip receivable in said cylinder channel and movable radially in said channel, said tightening strip having a tightening strip width, an upper base surface, a lower base surface and spaced tightening strip lateral surfaces, said cylinder channel having a channel width greater than the sum of said tightening strip width and twice said packing thickness; and a cylinder groove disposed in one of said first and second channel lateral surfaces, said cylinder groove being sized to receive one of said leading and trailing suspension rails, said cylinder groove having an upper lateral surface and a lower lateral surface, one of said upper pressure surfaces of said one of said leading and trailing suspension rails cooperating with said upper lateral surface of said cylinder groove when said one of said leading and trailing suspension rails is disposed in said cylinder groove, said one of said leading and trailing suspension rails being secured in said cylinder groove by one of said tightening strip lateral surfaces when said tightening strip is moved radially in said cylinder channel to move said lower base surface of said tightening strip radially inwardly of said cylinder groove upper lateral surface.

3. The device for tightening and securing a packing in accordance with claim 2 wherein said left and right lateral legs of each said suspension rails are of different lengths.

4. The device for tightening and securing a packing in accordance with claim 3 wherein said suspension rail lateral leg which is secured to said print start portion of said packing, and which is adjacent said channel lateral surface is longer by at least one thickness of said packing than said suspension rail lateral leg secured to said print start portion of said packing and which is remote from said channel lateral surface.

5. The device for tightening and securing a packing in accordance with claim 3 wherein said suspension rail lateral leg which is secured to said print end portion of said packing, and which is adjacent said channel lateral surface is shorter by at least one thickness of said packing than said suspension rail lateral leg secured to said print end portion of said packing which is remote from said channel lateral surface.

6. The device for tightening and securing a packing in accordance with claim 2 wherein each of said lateral legs has a leg thickness and further wherein said leg thickness is less than said packing thickness.

7. The device for tightening and securing a packing in accordance with claim 2 wherein said tightening strip is generally rectangular in cross-sectional shape and wherein said tightening strip width is generally the same as a width of said channel less twice said packing thickness.

8. A device for tightening and securing a packing comprising:

a cylinder;

a packing, said packing having a print start portion, a print end portion, and a packing thickness;

a U-shaped cylinder channel formed in said cylinder, said cylinder channel extending generally parallel to an axis of rotation of said cylinder, said cylinder channel having first and second channel lateral surfaces and a channel base surface;

leading and trailing suspension rails on said print start and print end portions of said packing, each of said suspension rails having left and right lateral legs, each of said lateral legs having an upper pressure surface, said suspension rail lateral leg secured to said print start portion of said packing, and which is adjacent said channel lateral surface being longer by at least one thickness of said packing than said suspension rail lateral leg secured to said print start portion of said packing and which is remote from said channel lateral surface;

a tightening strip receivable in said cylinder channel and movable radially in said channel, said tightening strip having a tightening strip width, an upper base surface, a lower base surface and spaced tightening strip lateral surfaces, said cylinder channel having a channel width greater than the sum of said tightening strip width and twice said packing thickness; and a cylinder groove disposed in one of said first and second channel lateral surfaces, said cylinder groove being sized to receive one of said suspension rails, said cylinder groove having an upper lateral surface and a lower lateral surface, one of said upper pressure surfaces of said trailing suspension rail cooperating with said upper lateral surface of said cylinder groove where said tightening strip is in said cylinder channel.

* * * * *

UNITED STATES PATENT AND TRADEMARK OFFICE

CERTIFICATE OF CORRECTION

PATENT NO. : 5,809,889

DATED : Sep. 22, 1998

INVENTOR(S) : Helmut Holm

It is certified that error appears in the above-identified patent and that said Letters Patent is hereby corrected as shown below:

On the title page, insert item [56]

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION | |
|---|---|---|---|---|---|---|---|---|---|---|---|---|---|---|
| | | | | | | | | | | | | | YES | NO |
| | | 5 | 6 | 5 | 5 | 3 | 7 | | 8/93 | Japan | | | | |
| | | | | | | | | | | | | | | |

Signed and Sealed this

Sixteenth Day of March, 1999

*Attest:*

Q. TODD DICKINSON

*Attesting Officer*

*Acting Commissioner of Patents and Trademarks*